US006029753A

United States Patent [19]

Kuusento et al.

[11] Patent Number: 6,029,753

[45] Date of Patent: Feb. 29, 2000

[54] INCREASED EFFICIENCY PERCUSSION PISTON AND METHOD FOR OPERATING SAME

[76] Inventors: Jaakko Kuusento, Naavakatu 10, FIN-33340 Tampere; Hannu Paasonen, Harjukatu 31 C, FIN-37100 Nokia, both of Finland

[21] Appl. No.: 08/952,713

[22] PCT Filed: May 23, 1995

[86] PCT No.: PCT/FI95/00280

§ 371 Date: Nov. 24, 1997

§ 102(e) Date: Nov. 24, 1997

[87] PCT Pub. No.: WO96/37345

PCT Pub. Date: Nov. 28, 1996

[51] Int. Cl.[7] ..... B25D 9/04

[52] U.S. Cl. ..... 173/1; 173/115; 173/206; 173/207; 173/11; 173/126

[58] Field of Search ..... 173/2, 4, 11, 13, 173/17, 115, 102, 126, 131, 206, 207, 208, 1

[56] References Cited

U.S. PATENT DOCUMENTS

| | | | |
|---|---|---|---|
| 4,052,107 | 10/1977 | Hay | 173/207 |
| 4,460,051 | 7/1984 | Widmer | 173/208 |
| 4,817,737 | 4/1989 | Hamada et al. | 173/115 |
| 4,858,702 | 8/1989 | Piras | 173/208 |
| 4,899,836 | 2/1990 | Venot | 173/207 |
| 5,056,606 | 10/1991 | Barthomeuf | 173/131 |

FOREIGN PATENT DOCUMENTS

| | | |
|---|---|---|
| 466 949 | 5/1984 | Sweden . |
| 1268-721 | 11/1986 | U.S.S.R. . |
| WO 91/15652 | 10/1991 | WIPO . |

*Primary Examiner*—Scott A. Smith
*Attorney, Agent, or Firm*—Larson & Taylor

[57] ABSTRACT

A percussion piston for use in a drilling apparatus includes a drill bit and at least three tubular parts which increase in diameter in a direction extending from the drill bit toward a rear end of the piston. The piston further includes flanges positioned between the tubular parts and a first corresponding delivery space at the rear end of the piston. At least two additional corresponding delivery spaces are positioned between the first corresponding delivery space and the drill bit. Channels allow the transport of pressurized hydraulic fluid to and from the first and additional corresponding delivery spaces such that an energy pulse produced by impact of the piston on the drill bit is almost completely absorbed by the drilled object.

8 Claims, 2 Drawing Sheets

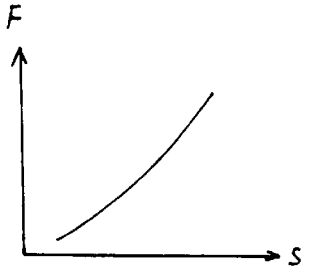
Fig. 1
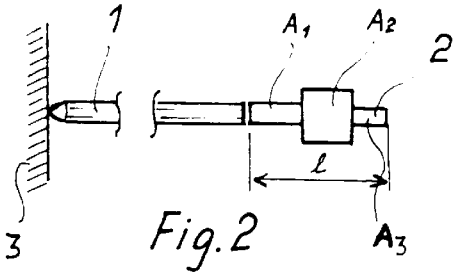
Fig. 2
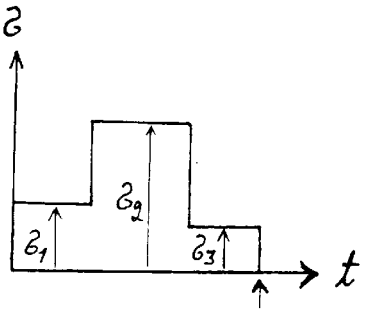
Fig. 3 $T = \frac{2 \cdot l}{u}$
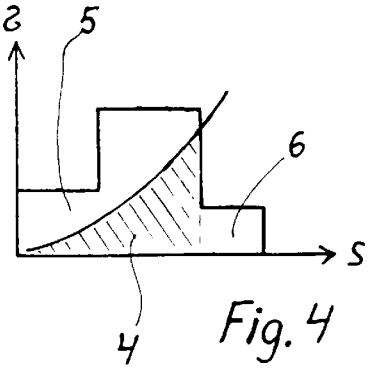
Fig. 4
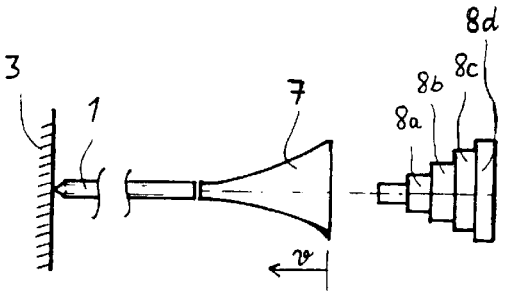
Fig. 5

INCREASED EFFICIENCY PERCUSSION PISTON AND METHOD FOR OPERATING SAME

FIELD OF THE INVENTION

The present invention relates to a drilling apparatus furnished with a percussion piston and more particularly to a percussion piston producing an energy pulse having a shape best absorbable by the rock material that is being drilled, and a method for drilling using the percussion piston.

BACKGROUND OF THE INVENTION

Generally, percussion pistons comprise a piston in which one flange portion formed in the piston, is a means moving the piston to and fro by varying the pressure on either side of the flange. The pressure puts the piston into acceleration towards the drill rod and the piston is also returned to its initial position by pressure. From the bit of the drill rod, the impact energy is absorbed into rock that is being drilled. The required drilling force grows as a function of penetration, when the bit starts to penetrate from its initial position against the rock by impact force. If, with regard to time or penetration, the shape of the energy pulse transmitted to the drill rod does not correspond to an energy pulse shape which the rock being drilled can absorb, a portion of the energy pulse must, inconveniently, reflect back to the drill rod. The pulse shape transmitted to the drill rod on percussion, depends on the piston length and its sonic speed in the piston material. In previous designs no attention has been paid either to the shape of the onward pulse or to shaping it in the drill rod.

SUMMARY OF THE INVENTION

According to the invention an almost optimal energy pulse shape is achieved, which the material to be drilled can absorb almost completely from the drill bit without any inconvenient reflections backward.

The advantage of this invention is that, the impact energy will be better used for rock drilling, reflection as energy pulses back to the piston will lessen and the stress on the drill rod and the drill bit will diminish along with the reduction of their alternating stress. With a piston diameter growing stepwise, the piston movements can be produced, advantageously, by means of hydraulic pressure.

BRIEF DESCRIPTION OF THE DRAWINGS

In the following the invention is disclosed with reference to the enclosed drawing, where FIG. 1 shows the dependency between force directed on the bit and penetration.

FIG. 2 shows a conventional percussion piston and the drill rod.

FIG. 3 shows a stress pulse from the piston in FIG. 2 getting transmitted to the bit.

FIG. 4 shows a combination of FIGS. 1 and 3.

FIG. 5 shows an ideal piston construction.

DETAILED DESCRIPTION OF THE INVENTION

Figure 6:
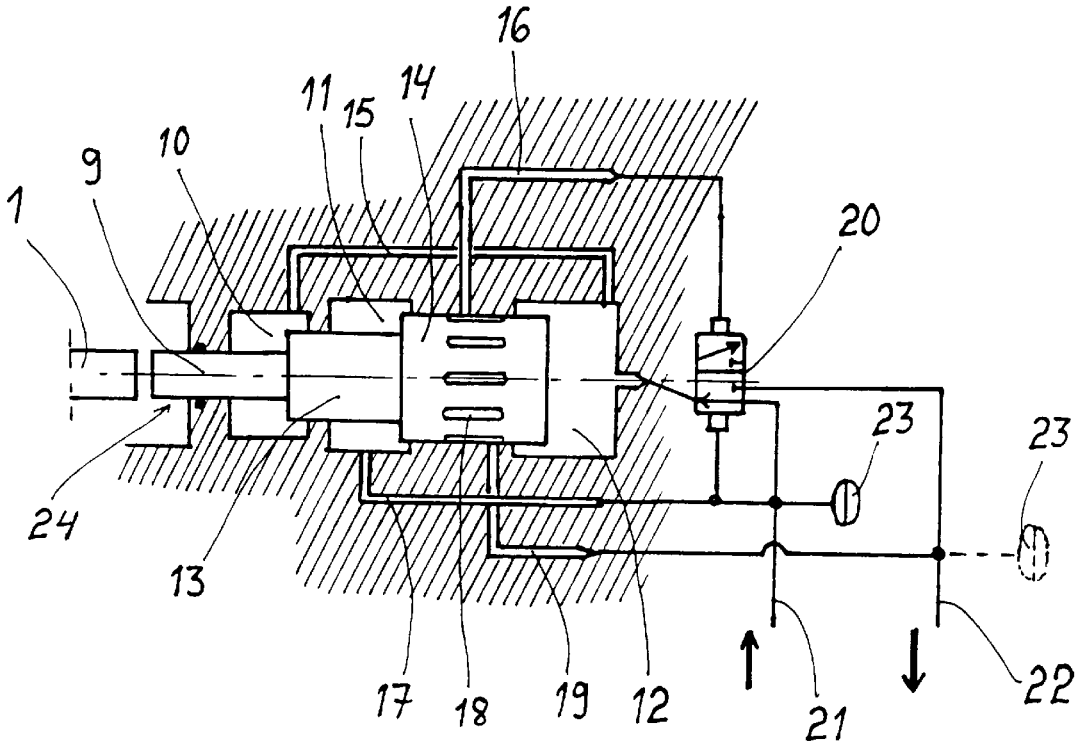
FIG. 6 shows a piston and its travel system, according to the present invention.

In FIG. 1 the dependency between force F on the bit and bit penetration s is illustrated. The required force, e.g. on drilling rock, grows according to the exponential curve as a function of penetration s, when in starting position the bit rests against the rock.

FIG. 2 shows drill rod 1 drilling rock 3 and a conventional piston 2 hitting the rock. The piston length is 1 and piston 2 comprises three cylindrical parts with cross-sections A1, A2 and A3. By impact on both flange surfaces of the middle cylindrical part, which has the largest diameter of the three parts the piston is moved to and fro.

FIG. 3 an energy pulse being transmitted while piston 2 as per FIG. 2 is striking. The stress is shown by U1, U2 and U3. Time T is 2×I/U, where U is the sonic speed in the piston material. The energy pulse shape reflects the different masses of the three cylindrical parts comprising piston 2, when they are travelling at sonic speed, U.

In FIG. 4 the delineators of FIG. 1 and FIG. 3 have been put in the same coordinate system. This shows that the rock to be drilled cannot absorb, completely, the energy pulse produced by piston 2 of FIG. 2. Area 4 shows energy absorbed into rock 3, area 5 shows energy reflecting back as a tensile pulse along the drill rod and area 6 shows energy reflecting back as a compression pulse. These pulses of tensile stress, reflected on the drill rod, add to the fatigue stress of the drill rod, as do the reflecting pulses of compression stress, which often on, also tend to accumulate with a new pulse from the percussion piston, when long drill rods are used. Since the service life of a drill rod is a matter of great influence on the economic efficiency of drilling, these facts lead to the theoretical conclusion, that the percussion piston should be conical even with a curved flank line. Likewise, an energy pulse produced in this way would be totally transmittable to the drilling object in order to improve the operating efficiency.

Such an ideal piston is illustrated in FIG. 5, where piston 7 hits the drill rod by a final speed v. Since it is, in practice, almost impossible to make the ideal piston work hydraulically, an ideal solution may be approached, for instance, in making the piston grow stepwise toward its rear by diameter changes 8*a*–8*d*. An energy pulse transmitted to drill rod 1 can then be made to correspond, sufficiently, to the absorbed energy, while the material being drilled is crumbling.

FIG. 6 shows one of the presented solutions according to the invention, where there is a drill rod 1 and a piston 24 growing backward inside the frame. The piston consists of three parts 9, 13 and 14, into which corresponding delivery spaces 10, 11 and 12 are connected. Spaces 10 and 12 are interconnected by a channel 15. Space 11 is connected by channel 17 to delivery line 21, hydraulic accumulator 23, and to steer valve 20. From grooves 18 in the bigger part 14 there is a connection to outlet line 22 in channel 19 and in channel 16 to steer valve 20.

When the inlet of hydraulic fluid is coupled to line 21, the space 11 and the flange of part 14 moving inside it become pressurized. In a position as per FIG. 6, the channels 16 and 19 are connected by grooves 18 to one another and to the low pressure outlet line 22 and the valve 20 takes then the position shown in the figure. Hydraulic fluid is guided to the rear flange of the piston in space 12 and further over channel 15 to space 10, where the smallest flange is located. Thus all piston flanges, i.e. the shoulders, are under working pressure, which results in that the piston movement against drill rod 1 is accelerated by pressure acting in space 12 only on an area as big as the cross-section of the rod portion 9. Other piston diameters can be freely selected.

Piston acceleration is intensified, when oil from spaces 10 and 11 is steered also to space 12 (channels 15, 17, 21), whereat the volume of oil flow to space 12 grows substantially.

When the piston has travelled far enough, channel 16 becomes pressurized, while grooves 18 connect the channel to space 11, where working pressure exists. The valve 20 takes then another position and pressurized spaces 10 and 12 reach low pressure, when they open into the return channel 22. Mainly, the piston reversing force is formed by the pressure of the middlemost space 11. When the reverse stroke has reach far enough, channels 16 and 19 are connected to the return line over grooves 18 and the valve changes its position to a piston-accelerating position.

If there are even more shoulders in the piston, the connection is most conveniently made as per FIG. 6, which means that all forming spaces are under working pressure during piston acceleration, whereby the piston accelerates to strike, while the rear space cross-section area is greater than the shoulder areas counter-working the movement.

For the reverse travel, one shoulder area is left under working pressure and other spaces are opened to the outlet line 22 by different valve arrangements.

To make the pulse energy curve resemble the curve of FIG. 1, there must be in the piston construction continuous or discontinuous alteration, for instance stepwise change towards piston rear end. While increasing diameter is one way to achieve alteration, concentration of piston mass backward without increasing the outer piston diameter, will have the same effect. This can be done using a hollow tubular piston with the inner hole made smaller towards the piston rear end and thus mass per unit of length can increased toward the piston rear end.

The invention is not restricted to the enclosed embodiment but several modifications are possible within the inventional concept specified in the patent claims.

We claim:

1. A method of drilling using a percussion piston comprising a drill bit positioned at a front end of said piston and at least three tubular parts, said tubular parts increasing in diameter in a direction from the drill bit toward a rear end of the piston, flanges positioned between said tubular parts, a first corresponding delivery space at the rear end of said piston, at least two additional corresponding delivery spaces positioned between said first delivery space and said drill bit, and channels for transporting pressurized hydraulic fluid to and from said first and two additional delivery spaces, said method comprising:

introducing hydraulic fluid into said first and two additional corresponding delivery spaces to initiate piston acceleration;

arranging the surface area of the rear end of the piston in the first corresponding delivery space to be larger than surface areas of the piston flanges in the two additional delivery spaces in order to accelerate the piston by means of the working pressure; and releasing the working pressure at least in the first corresponding delivery space after the piston strikes in order to reverse the piston direction.

2. The method according to claim 1 further comprising:

maintaining working pressure in the channels delivering hydraulic fluid to one of said two additional corresponding delivery spaces and releasing working pressure in the remaining channels in order to reverse piston direction.

3. The method according to claim 1 further comprising:

maintaining working pressure in one of said two additional corresponding delivery spaces, and releasing working pressure in said first corresponding delivery space and the remaining additional corresponding delivery spaces in order to reverse piston direction.

4. The method according to claim 3 further comprising:

maintaining working pressure in channels delivering hydraulic fluid to one of said two additional corresponding delivery spaces and releasing working pressure in the remaining channels in order to reverse piston direction.

5. The method according to claim 1 further comprising:

increasing the hydraulic fluid flow to the first corresponding delivery space by introducing the hydraulic fluid from the two additional corresponding delivery spaces to said first corresponding delivery space in order to intensify piston acceleration.

6. A percussion piston for use in a drilling apparatus, said piston comprising:

a drill bit positioned at a front end of said piston;

at least three tubular parts, said tubular parts increasing in diameter in a direction from the drill bit toward a rear end of the piston;

flanges positioned between said tubular parts;

a first corresponding delivery space at the rear end of the piston;

at least two additional corresponding delivery spaces positioned between said first corresponding delivery space and said drill bit; and channels for transporting pressurized hydraulic fluid to said first and said two additional corresponding delivery spaces, whereby energy pulse produced by impact of the piston on the drill bit is almost completely absorbed by the drilled object.

7. The percussion piston according to claim 6 wherein at least one of said channels for transporting further transports pressurized hydraulic fluid between at least one of said two additional corresponding delivery spaces and said first corresponding delivery space whereby working pressure is released from at least one of said two additional corresponding delivery spaces after the piston strikes.

8. The percussion piston according to claim 6 wherein at least one of said channels for transporting further transports pressurized hydraulic fluid to one of said two additional corresponding delivery spaces after the piston strikes in order to increase working pressure and reverse piston direction.

* * * * *